US010602892B2

(12) United States Patent
Matsushita et al.

(10) Patent No.: US 10,602,892 B2
(45) Date of Patent: Mar. 31, 2020

(54) TOILET SEAT AND COVER APPARATUS

(71) Applicant: TOTO LTD., Kitakyushu-shi, Fukuoka (JP)

(72) Inventors: Hiroyoshi Matsushita, Kitakyushu (JP); Sachiko Niwano, Kitakyushu (JP); Yuji Yoshioka, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/883,424

(22) Filed: Jan. 30, 2018

(65) Prior Publication Data

US 2018/0213984 A1 Aug. 2, 2018

(30) Foreign Application Priority Data

Feb. 1, 2017 (JP) ..... 2017-016862

(51) Int. Cl.
*A47K 13/26* (2006.01)
*E03D 9/08* (2006.01)
*A47K 13/24* (2006.01)

(52) U.S. Cl.
CPC ..... *A47K 13/26* (2013.01); *A47K 13/24* (2013.01); *E03D 9/08* (2013.01)

(58) Field of Classification Search
CPC ..... A47K 13/26; A47K 13/24; E03D 9/08
USPC ..... 4/420.1, 420.3, 420.4, 444, 447
See application file for complete search history.

(56) References Cited

U.S. PATENT DOCUMENTS

D287,998 S * 1/1987 Holscher ..... D23/311
5,319,811 A * 6/1994 Hauri ..... E03D 9/08 4/420.4
D348,926 S * 7/1994 Rasmussen ..... D23/311
D377,208 S * 1/1997 Kivela ..... D23/311
D604,812 S * 11/2009 Kuang ..... D23/295
D620,568 S * 7/2010 Giovannoni ..... D23/311
D642,247 S * 7/2011 Jiang ..... D23/295
8,082,607 B2 * 12/2011 Matsushita ..... A47K 13/24 4/302
9,283,144 B2 * 3/2016 Bickerstaffe ..... E03D 9/08
D796,017 S * 8/2017 Yoshioka ..... D23/295
2012/0117722 A1 5/2012 Mochita et al.
2013/0298321 A1 11/2013 Vierkant, III et al.
2016/0174783 A1 * 6/2016 Mantel ..... A47K 13/26 4/420.5

(Continued)

FOREIGN PATENT DOCUMENTS

CN 201704763 U 1/2011
CN 203802371 U 9/2014

(Continued)

*Primary Examiner* — Erin Deery
(74) *Attorney, Agent, or Firm* — Pearne & Gordon LLP

(57) ABSTRACT

According to one embodiment, a toilet apparatus includes a toilet bowl, a base plate, a cover plate, and a toilet seat. The base plate is provided on a rear part of the toilet bowl. A washing function part washing an ano-genital region of a human body is mounted on the base plate. The cover plate is provided on the base plate. The cover plate covers the washing function part from above. The toilet seat is provided on the toilet bowl. The toilet seat is pivotally rotatable to the toilet bowl. In a state where the toilet seat is lowered, the toilet seat is positioned in a projection range where the toilet bowl is projected upward, and covers the cover plate from above.

13 Claims, 7 Drawing Sheets

(56) References Cited

U.S. PATENT DOCUMENTS

2017/0138034 A1* 5/2017 Mizoguchi ..... E03D 9/08

FOREIGN PATENT DOCUMENTS

| | | | | |
|---|---|---|---|---|
| EP | 3 006 634 | A1 | 4/2016 | |
| FR | 2937849 | A1 * | 5/2010 | ..... A47K 13/12 |
| JP | D1238632 | S | 3/2005 | |
| JP | 2007-291644 | A | 11/2007 | |
| JP | 2009-207568 | A | 9/2009 | |
| JP | D1398115 | S | 9/2010 | |
| TW | 200812538 | A | 3/2008 | |
| TW | I 473928 | B | 2/2015 | |

* cited by examiner

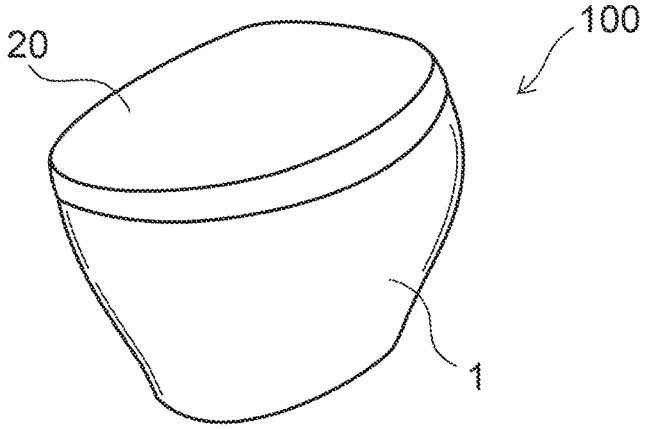
FIG. 1A
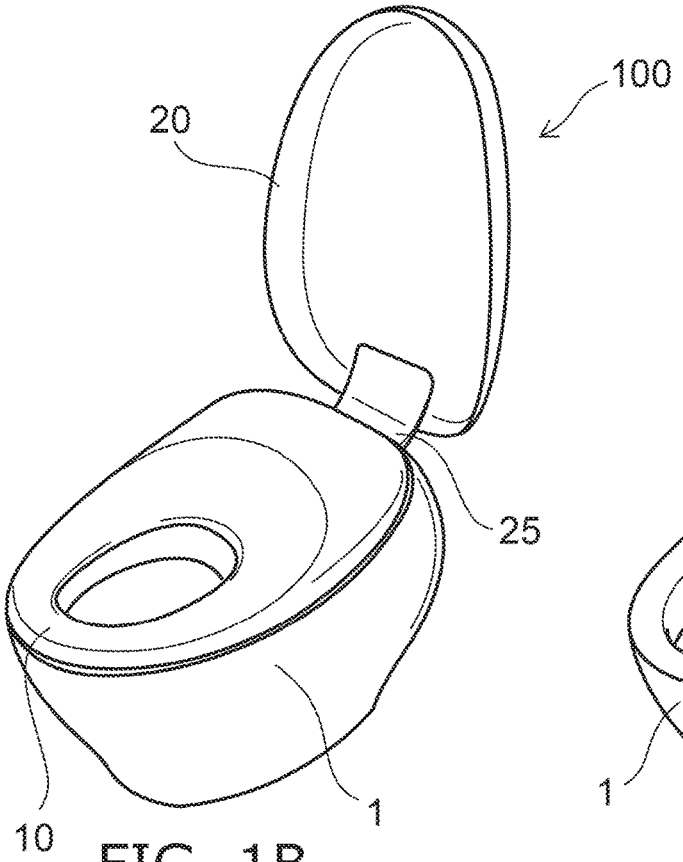
FIG. 1B
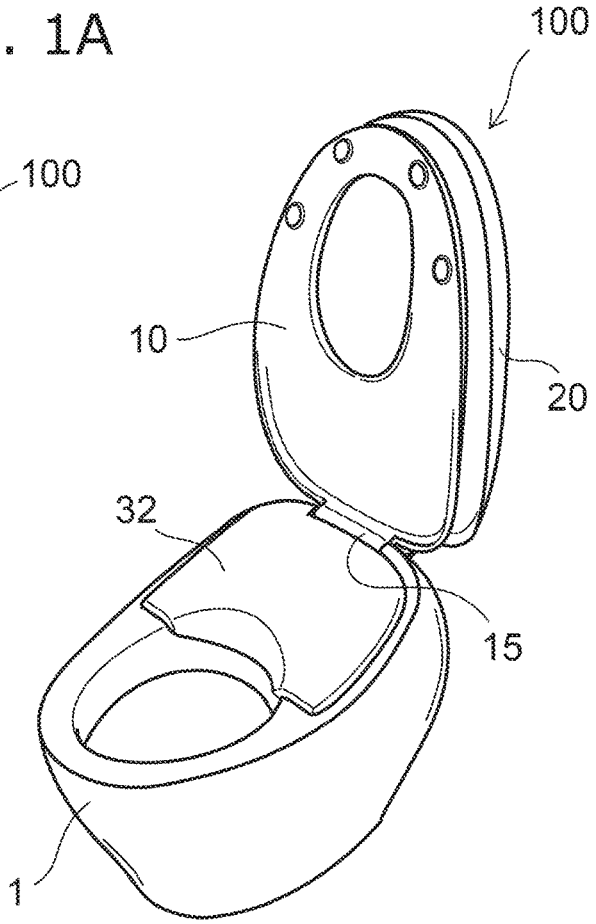
FIG. 1C
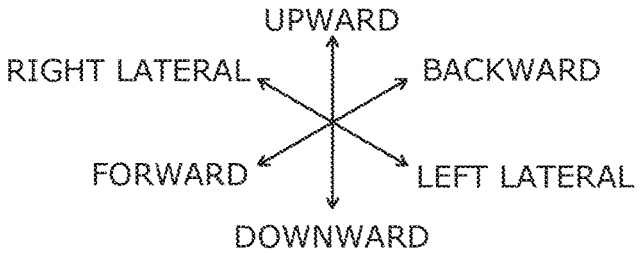

-PRIOR ART-

-PRIOR ART-

TOILET SEAT AND COVER APPARATUS

CROSS-REFERENCE TO RELATED APPLICATIONS

This application is based upon and claims the benefit of priority from Japanese Patent Application No. 2017-016862, filed on Feb. 1, 2017; the entire contents of which are incorporated herein by reference.

FIELD

Embodiments described herein relate generally to a toilet apparatus.

BACKGROUND

A toilet apparatus including a functional component has been known. The functional component includes a washing device washing an ano-genital region of a human body and a casing housing the washing device. JP 2016-43138 A (Kokai) discusses a toilet bowl device including a toilet seat hiding a functional component and a hinge mechanism and making view from the exterior impossible for suppressing adhesion of foreign mater such as dust or the like to the functional component and the hinge mechanism.

However, according to the technique discussed in JP 2016-43138 A (Kokai), although the adhesion of the foreign matter to the functional component can be suppressed, a size of toilet seat increases excessively, and usability is not good.

The invention has been made on the basis of recognition of such a problem, the purpose is to provide a toilet apparatus which can suppress the adhesion of the foreign matter to a member in which the washing device is housed while suppressing the size increase and deterioration of the usability.

SUMMARY

According to an embodiment, a toilet apparatus includes a toilet bowl, a base plate, a cover plate, and a toilet seat. The base plate is provided on a rear part of the toilet bowl. A washing function part washing an ano-genital region of a human body is mounted on the base plate. The cover plate is provided on the base plate. The cover plate covers the washing function part from above. The toilet seat is provided on the toilet bowl. The toilet seat is pivotally rotatable to the toilet bowl. In a state where the toilet seat is lowered, an outer edge of the toilet seat is positioned at a same position as or inside of an outer edge of the toilet bowl, and covers the cover plate from above.

BRIEF DESCRIPTION OF THE DRAWINGS

FIG. 1A to FIG. 1C are perspective views showing toilet apparatuses 100 according to an embodiment;

DETAILED DESCRIPTION

Figure 2:
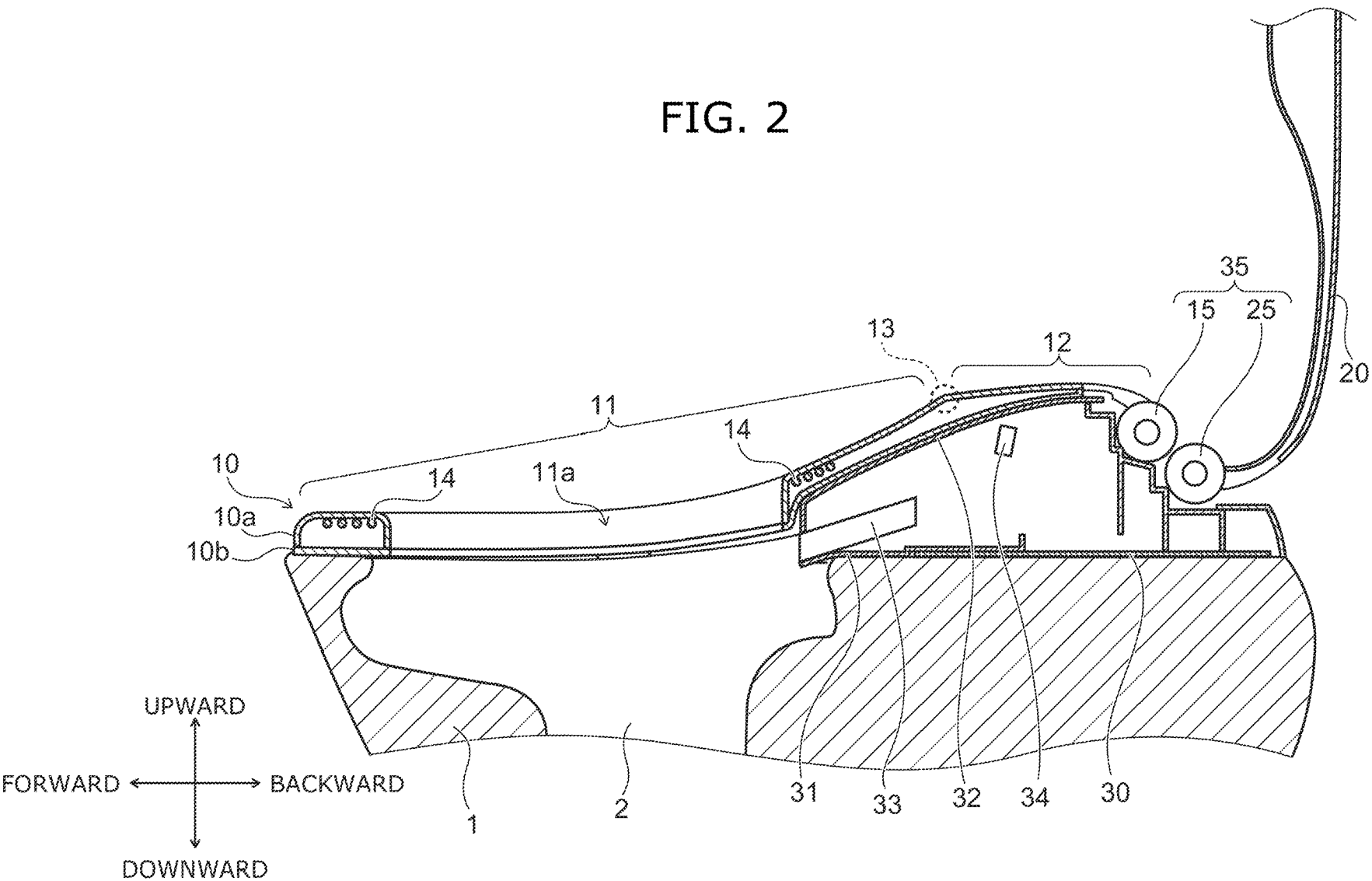
FIG. 2 is a cross-sectional view showing a portion of the toilet apparatus according to the embodiment.

The first invention relates to a toilet apparatus. The toilet apparatus includes a toilet bowl, a base plate, a cover plate, and a toilet seat. The base plate is provided on a rear part of the toilet bowl. A washing function part washing an ano-genital region of a human body is mounted on the base plate. The cover plate is provided on the base plate. The cover plate covers the washing function part from above. The toilet seat is provided on the toilet bowl. The toilet seat is pivotally rotatable to the toilet bowl. In a state where the toilet seat is lowered, an outer edge of the toilet seat is positioned at a same position as or inside of an outer edge of the toilet bowl, and covers the cover plate from above.

According to the toilet apparatus, it becomes possible to suppress the adhesion of dust and dirt to the cover plate by the toilet seat while suppressing increase in size and deterioration of the usability.

The second invention is the toilet apparatus in the first invention, wherein the toilet seat includes a seating part provided with an opening, and a covering part provided behind the seating part and covering at least a portion of the cover plate from above in the state where the toilet seat is lowered, the seating part is provided so as to be distinguishable from the covering part.

According to the toilet apparatus, since it becomes easier to understand which part of the toilet seat the user should sit on, the usability is improved.

Third invention is the toilet apparatus in the first invention, wherein the toilet seat includes a seating part provided with an opening, and a covering part provided behind the seating part and covering at least a portion of the cover plate from above in the state where the lowered toilet seat is lowered, the seating part is bent downward in a convex shape in a direction from a front end of the toilet seat to a rear end of the toilet seat, the covering part is bent upward in a convex shape in the direction.

According to the toilet apparatus, since the covering part has a different shape from the seating part, the seating part becomes clear to the covering part, and it is possible to suppress the illusion that the opening of the seating part looks small. Since the illusion can be suppressed, it is possible to reduce the possibility that the user feels a sense of discomfort to the toilet apparatus or hesitates using the toilet apparatus. Furthermore, since the seating part becomes clear, it is possible to guide the user to seat on the seating part, and it is possible to reduce the possibility of occurrence of the toilet seat damage.

The fourth invention is the toilet apparatus in the third invention, wherein the covering part is further bent upward in a convex shape in a direction from one side of the toilet seat to another side of the toilet seat.

According to the toilet apparatus, when a force is applied due to riding on or seating on the covering part, the force is dispersed and the possibility of the toilet seat damage can be reduced.

The fifth invention is the toilet apparatus in one of the second to fourth inventions, further including an input unit provided on the covering part, the input unit executing washing of the toilet bowl.

According to the toilet apparatus, even if a means executing the washing of the toilet bowl is provided on a remote control, the user can wash the toilet bowl by putting the input unit. Therefore, the washing of the toilet bowl can be performed even when the battery of the remote control runs out.

The sixth invention is the toilet apparatus in one of the first to fifth inventions, further comprising a toilet lid provided on the toilet seat, the toilet lid being pivotally rotatable to the toilet bowl, a rear end of the toilet seat being pivotally supported to the toilet bowl by a first pivotally supporting part, a rear end of the toilet lid being pivotally supported to the toilet bowl by a second pivotally supporting part, the first pivotally supporting part being provided behind the cover plate, the second pivotally supporting part being provided behind the first pivotally supporting part, and being positioned under the first pivotally supporting part, the rear end of the toilet seat being bent downward in the state where the toilet seat is lowered, and the rear end of the toilet lid is bent downward in a state where the toilet lid is closed.

According to the toilet apparatus, it is possible to decrease in size of a unit including the toilet lid, the first pivotally supporting part, and the second pivotally supporting part. As a result, it becomes possible to decrease in size of the toilet apparatus.

The seventh invention is the toilet apparatus in one of the first to sixth inventions, wherein peripheral portions of the toilet bowl are raised in a direction toward a rear end of the toilet bowl, and the base plate is covered laterally by the raised peripheral portions of the toilet bowl.

According to the toilet apparatus, it is possible to further suppress the adhesion of the dust or dirt or the like to the base plate and the washing function part mounted on the base plate. It is possible to decrease in size of the toilet seat in comparison with the case of covering the lateral of the base plate with the toilet seat, and the usability of the toilet apparatus can be improved.

Various embodiments will be described hereinafter with reference to the accompanying drawings. In the drawings, the same reference numbers are applied to the same elements and the detailed description will be omitted as appropriate.

In the specification of the application, for the description of the invention, "upward", "downward", "forward", "backward", "left lateral", and "right lateral" are used, and these have the case of viewing from the user seating on a toilet seat 10 described later as a reference.

FIG. 1A to FIG. 1C are perspective views showing toilet apparatuses 100 according to an embodiment. FIG. 1A shows the situation of lowering the toilet seat 10 and closing a toilet lid 20. FIG. 1B shows the situation of lowering the toilet seat 10 and opening the toile lid 20. FIG. 1C shows the situation of raising the toilet seat 10 and opening the toilet lid 20.

As shown in FIG. 1A to FIG. 1C, the toilet apparatus 100 includes a western style toilet bowl 1 (hereinafter, simply referred to as toilet bowl 1), and the toilet seat 10 and the toilet lid 20 provided thereon. A rear end of the toilet seat 10 is pivotally supported to the toilet bowl 1 by a first pivotally supporting part 15. A rear end of the toilet lid 20 is pivotally supported to the toilet bowl 1 by a second pivotally supporting part 25. The toilet seat 10 and the toilet lid 20 pivotally rotate to the toilet bowl 1 via the first pivotally supporting part 15 and the second pivotally supporting part 25. Thereby, vertical movement of the toilet seat 10 and opening and closing movement of the toilet lid 20 are performed.

FIG. 2 is a cross-sectional view showing a portion of the toilet apparatus according to the embodiment.

Figure 3:
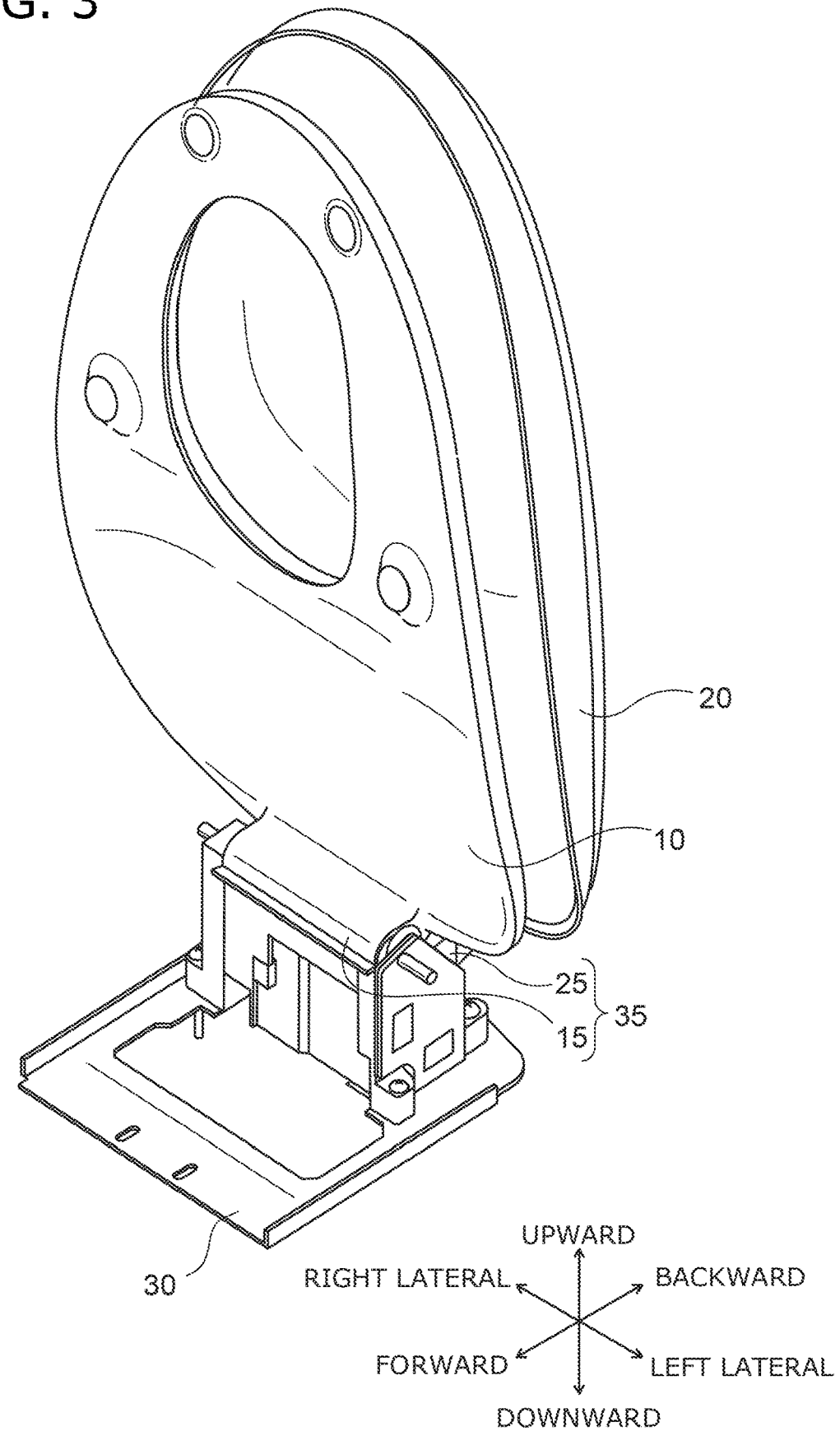
FIG. 3 is a perspective view showing a pivotally supporting unit of the toilet apparatus according to the embodiment.

FIG. 3 is a perspective view showing a pivotally supporting unit of the toilet apparatus 100 according to the embodiment.

Figure 4:
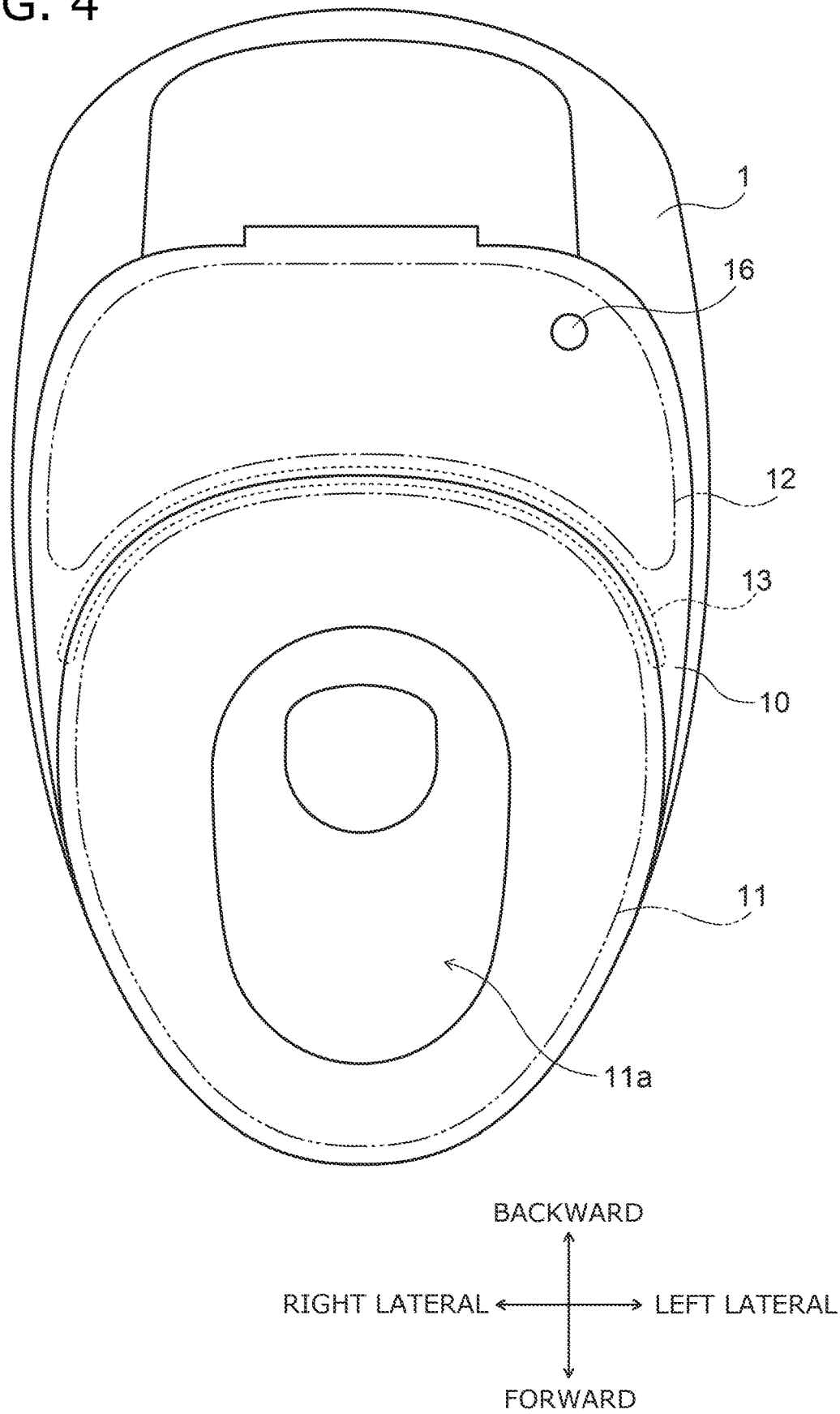
FIG. 4 is a plan view showing the toilet apparatus according to the embodiment.

FIG. 4 is a plan view showing the toilet apparatus 100 according to the embodiment.

FIG. 4 omits the toilet lid 20. FIG. 2 shows as a state where the toilet lid 20 is opened. FIG. 4 shows a state where the toilet seat 10 is lowered.

As shown in FIG. 2, a rear part of the toilet bowl 1 is provided with a bottom plate 30, a base plate 31, a cover plate 32, a washing nozzle (washing function part) 33, a radio wave sensor 34, and the pivotally supporting unit 35.

The bottom plate 30 is a plate made of a metal spreading along a front-back direction and a horizontal direction. The bottom plate 30 is fixed to the toilet bowl 1. The base plate 31 is placed on the bottom plate 30. Function parts such as the washing nozzle 33 and the radio wave sensor 34 or the like are mounted on the base plate 31. The washing nozzle 34 washes a human body ano-genital region such as "bottom". The radio wave sensor 34 emits a radio wave forward and detects the user of the toilet apparatus 100. Other than those, a heat exchanger controller or the like is mounted on the base plate 31. The heat exchanger warms the water supplied to the washing nozzle 33. The controller controls the operations of the washing nozzle 33 and the radio wave sensor 34.

The cover plate 32 is provided on the base plate 31. The cover plate 32 covers these function parts mounted on the base plate 31 from above. The cover plate 32 is covered with the toilet seat 10 from above in the state where the toilet seat 10 is lowered. In other words, the cover plate 32 is provided in a projection range where the toilet seat 10 is projected downward in the state where the toilet seat 10 is lowered. As shown in FIG. 1A, in the state where the toilet lid 20 is closed, the toilet seat 10 is covered with the toilet lid 20 from above.

The pivotally supporting unit 35 is a unit including the first pivotally supporting part 15 and the second pivotally supporting part 25, as shown in FIG. 2 and FIG. 3. The pivotally supporting unit 35 is fixed to the bottom plate 30. That is, the rear end of the toilet seat 10 and the rear end of the toilet lid 20 are pivotally supported to the toilet bowl 1 via the bottom plate 30 by the first pivotally supporting part 15 and the second pivotally supporting part 25, respectively.

The pivotally supporting unit 35 is provided behind the base plate 31 and the cover plate 32 as shown in FIG. 2. Therefore, in the state where the toilet seat 10 is lowered, the rear end of the toilet seat 10 is bent downward, goes around and behind the cover plate 32, and is connected to the first pivotally supporting part 15. The second pivotally supporting part 25 is positioned under the first pivotally supporting part 15. For this reason, in the state where the toilet lid 20 is closed, the rear end of the toilet lid 20 is bent downward, goes around the cover plate 32 and the first pivotally supporting part 15, and is connected to the second pivotally supporting part 25.

The toilet seat 10 is provided so as not to protrude from the toilet bowl 1 forward, backward, and to the left and right in the state where the toilet seat 10 is lowered. That is, in the state where the toilet seat 10 is lowered, as shown in FIG. 4, as viewed from above, an outer edge of the toilet seat 10 is positioned at the same position as or inside of an outer edge of the toilet bowl 1. In other words, the toilet seat 10 is positioned in the projection range where the toilet bowl 1 is projected upward in the state where the toilet seat 10 is lowered.

As shown in FIG. 2 and FIG. 4, the toilet seat 10 includes a seating part 11 and a covering part 12. The seating part 11 is provided with an opening 11*a* facing a bowl 2 of the toilet bowl 1. Thereby, the user can sit on the seating part 11 and relieve himself. The covering part 12 is provided behind the seating part 11. The covering part 12 covers at least a portion of the cover plate 32 from above.

In the example shown in FIG. 2, the cover plate 32 is covered with a portion of the seating part 11 and the covering part 12 from above. In the example shown in FIG. 2, the washing nozzle 33 is positioned under the rear part of the seating part 11. The radio wave sensor 34 is positioned under the covering part 12.

The seating part 11 and the covering part 12 are provided so as to enable the user to distinguish visually the seating part 11 from the covering part 12. For example, in the direction from the front end of the toilet seat 10 to the back end of the toilet seat 10, the covering part 12 is bent upward in a convex shape, and the seating part 11 is bent downward in a convex shape. In this way, since the seating part 11 is different from the covering part 12 in shape, the user can identify the seating part 11 from the covering part 12.

In the examples shown in FIG. 2 and FIG. 4, a bent portion 13 bent upward in a convex shape is provided between the covering part 12 and the seating part 11. Thereby, the user of the toilet apparatus 100 can easily identify a forward part from the bent portion 13 as the seating part 11.

The toilet seat 10 is, for example, formed by bonding an upper plate 10*a* and a lower plate 10*b* by welding or the like as shown in FIG. 2. A heater 14 for warming the seating part 11 is provided between the upper plate 10*a* and the lower plate 10*b* (inside the toilet seat 10). The heater is provided in a circular around the opening 11*a*.

In the toilet apparatus 100, for example, the user of the toilet apparatus 100 can perform washing of the toilet bowl 1 and washing of the ano-genital region by the washing nozzle 33 by operating the remote controller or the like not shown. In addition, a washing switch 16 is provided on the covering part 12 of the toilet seat 10 as shown in FIG. 3. The user can execute the washing operation of the toilet bowl 1 of the toilet apparatus 100 by pushing the washing switch 16.

The washing switch 16 includes, for example, an electric storage means such as a piezoelectric element and a capacitor, provided inside the toilet seat 10. When the washing switch 16 is pushed by a finger, a voltage (signal) is generated by the piezoelectric element. When the not shown washing means provided in the toilet apparatus 100 receives this signal, it sheds water into the bowl 2 in the toilet bowl 1 by using a power stored in the electric storage means, and washes the toilet bowl 1.

Figure 5:
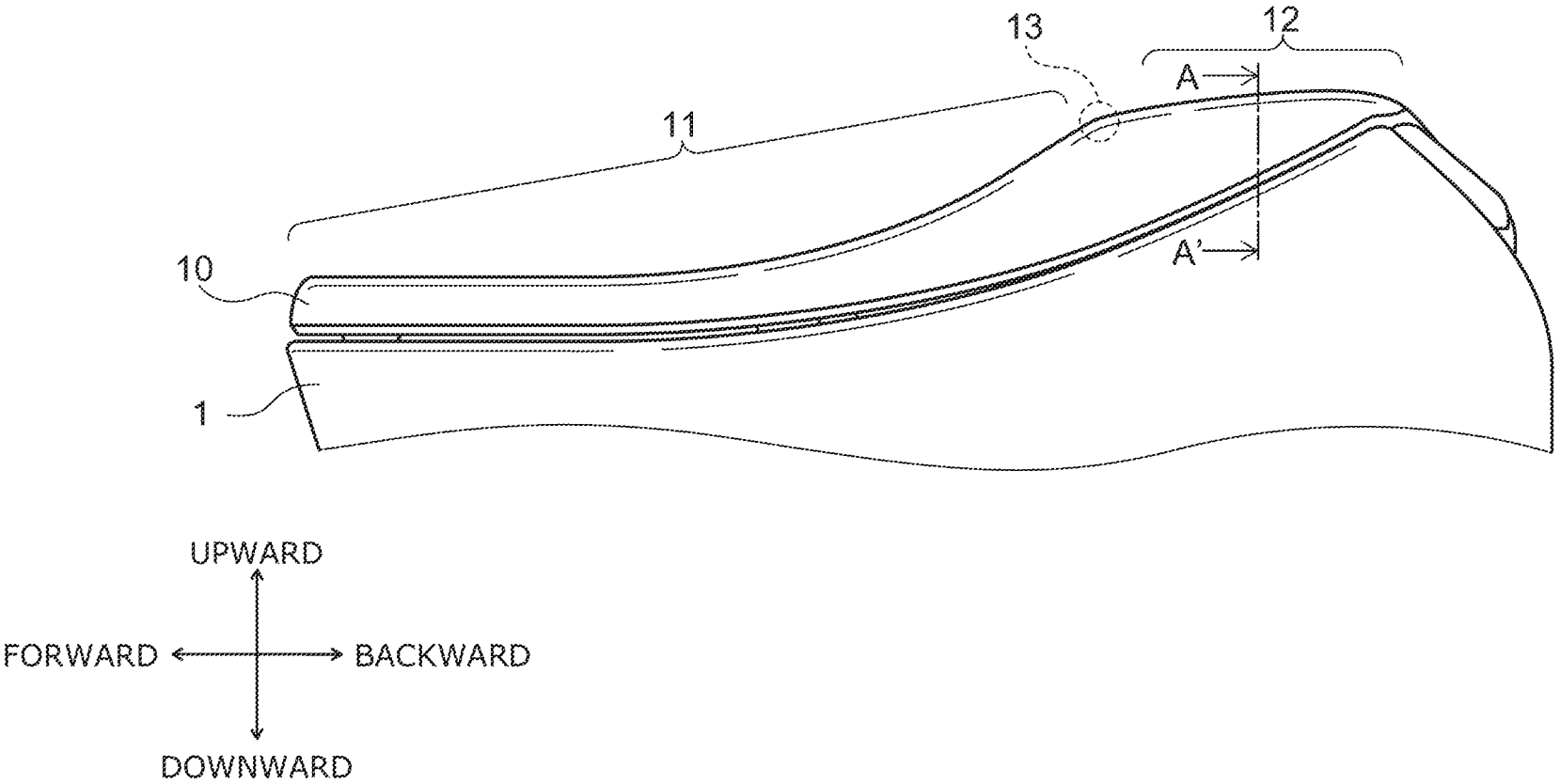
FIG. 5 is a side view showing a portion of the toilet apparatus according to the embodiment.

FIG. 5 is a side view showing a portion of the toilet apparatus 100 according to the embodiment.

Figure 6:
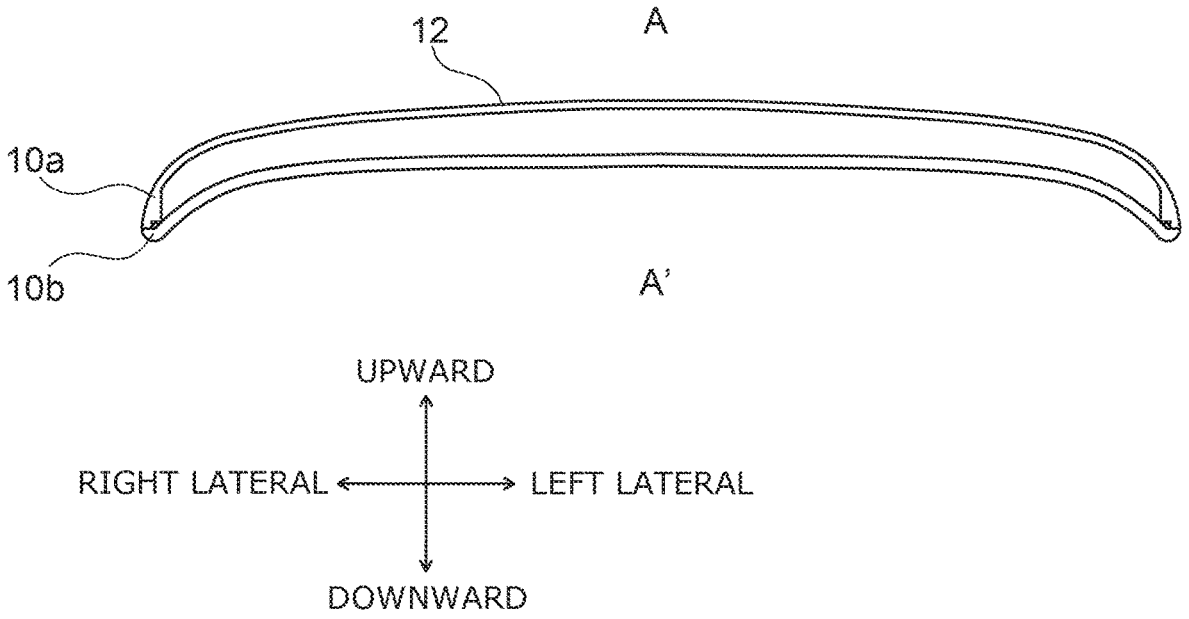
FIG. 6 is a cross-sectional view of the toilet seat along A-A' line of FIG. 5.

FIG. 6 is a cross-sectional view of the toilet seat 10 along A-A' line in FIG. 5.

In FIG. 5, the toilet lid 20 is omitted.

As shown in FIG. 5, the peripheral portions of the toilet bowl 1 are raised in a direction toward a rear end of the toilet bowl 1. That is, a vertical length of the toilet bowl 1 becomes greater in a direction toward a rear end of the toilet bowl 1. The base plate 31 and at least a portion of the pivotally supporting unit 35 are laterally covered by the raised peripheral portions.

A lower surface outer periphery of the toilet seat 10 is provided along the upper surface of the toilet bowl 1 from a front end of the toilet bowl 1 to the raised peripheral portions of the toilet bowl 1. An outer circumference of the cover plate 32 is, as shown in FIG. 1C, provided along the raised peripheral portions and is bridged over the upper surface of the toilet bowl 1.

As described above, the covering part 12 of the toilet seat 10 is bent upward in a convex shape in the direction from the front end of the toilet seat 10 to the back end of the toilet seat 10. The covering part 12 is, as shown in FIG. 6, further bent upward in a convex shape also in a direction from one side to another side.

Here, an effect of the embodiment will be described.

As described above, in the toilet apparatus 100 according to the embodiment, in the state where the toilet seat 10 is lowered, the cover plate 32 is covered with the toilet set 10 from above. For this reason, the adhesion of the dust and dirt to the cover plate 32 can be suppressed. In the state where the toilet seat 10 is lowered, an outer edge of the toilet seat 10 is provided so as to be positioned at a same position as or inside of an outer edge of the toilet bowl 1. For this reason, the increase in size of the toilet apparatus 100 and the deterioration of the usability can be suppressed.

That is, according to the embodiment, it becomes possible to suppress the adhesion of the dust and dirt to the cover plate 32 by the toilet seat 10 while suppressing the increase in size of the toilet apparatus 100 and the deterioration of the usability.

In the case where the toilet seat 10 includes the covering part 12 provided integrally with the seating part 11, the user may get lost as to which part of the toilet seat 10 the user should sit on. Therefore, it is desirable to provide the seating part 11 of the toilet seat 10 so as to be distinguishable from the covering part 12. In this way, the portion to be seated by the user becomes easy to be identified, and the usability of the toilet apparatus 100 can be further improved.

As a result of the verification by the inventors, the followings have been found about the toilet set 10 like this. When the seating part 11 and the covering part 12 are uniformly flat or uniformly bent upward in a convex shape, the opening 11*a* of the seating part 11 looks smaller than its actual scale.

The inventors further verified this point, and then the followings have been found. In the case where, in the direction from a front end of the toilet seat to a rear end of the toilet seat, the seating part 11 is bent downward in a convex shape and the covering part 12 is bent upward in a convex shape, the range of the seating part 11 is made clear over the covering part 12. Furthermore, the illusion that the opening 11*a* looks small can be suppressed.

Therefore, if adopting the configuration for the toilet seat 10, it is possible to reduce the possibility that the user feels a sense of discomfort and hesitates using the toilet apparatus. Since the seating part 11 is made clear, it is possible to guide the user to seat on the seating part 11. Thereby, it is possible to reduce the possibility that the user seats on the covering part 12 in error and damages the toilet seat 10.

The covering part 12 is desired to be bent convexly upward further also in the horizontal direction. According to the configuration, when a force is applied due to riding on or seating on the covering part, the force is dispersed. Thereby, the possibility of damaging the toilet seat 10 can be reduced. Particularly, in the case where the toilet seat 10 is formed by bonding a plurality of members, the bonded portion is easily damaged by the force being applied. However, according to the configuration, the damage can be suppressed from occurring.

The base plate 31 and the function part mounted thereon are covered with the cover plate 32 and the toilet seat 10 from above. Therefore, it is possible to suppress the dust or dirty or the like flying from above from adhering to the function part on the base plate 31. At this time, it is preferable that the base plate 32 is laterally covered from right and left, and the dust or dirty or the like flying from right and left lateral can also be suppressed from adhering.

With respect to this point, in the embodiment, the peripheral portions of the toilet bowl 1 are raised in a direction toward a rear end of the toilet bowl 1, and the base plate 31 is covered laterally by the raised peripheral portions of the toilet bowl 1. Therefore, it is possible to further suppress the adhesion of the dust or dirt or the like to the base plate 31 and the function part mounted on the base plate. In this way, the side part of the base plate 31 is covered with the portion of the toilet bowl 1, and thus it is possible to decrease in size of the toilet seat 10 in comparison with the case of covering the lateral of the base plate 31 with the toilet seat 10, and the usability of the toilet apparatus 100 can be improved.

Furthermore, according to the configuration of the embodiment, in the case where a heat source such as a heat exchanger is provided under the cover plate 32, the heat generated in the heat source is easily to be transmitted from the backward portion of the toilet seat 10 covering the cover plate 32 to the frontward portion where the user seats. Or in the case where the heater 14 is built in the frontward portion of the toilet seat 10, the heat generated in the heater 14 is easily transmitted from the frontward portion of the toilet seat 10 to the heat source downward the cover plater 32.

In addition, the toilet seat 10 is provided in the projection range of the toilet bowl 1 and is not increased in size, and thus the heat transmitted from the heat source and the heater 14 downward the cover plate 32 to the toilet seat 10 can be suppressed from being dispersed meaninglessly. Thereby, it becomes possible to transmit the heat efficiently mutually. Therefore, according to the embodiment, in the case where the heat exchanger and the heater 14 are provided on the toilet apparatus 100, power consumption in the equipment generating these heats can be reduced.

The toilet seat 10 is provided with the washing switch 16 (input unit). Even if the washing switch is provided also on the remote controller (nor shown), the user of the toilet apparatus 100 can wash the toilet bowl 1 by pushing the washing switch 16. Therefore, even when the battery of the remote controller runs out, the toilet bowl can be washed.

Furthermore, in the toilet apparatus 1200 according to the embodiment, the rear end of the toilet seat 10 and the rear end of the toilet lid 20 are pivotally supported to the toilet bowl 1 by the first pivotally supporting part 15 and the second pivotally supporting part 25. In the state where the toilet seat 10 is lowered and the toile lid 20 is closed, the respective rear ends are bent downward. In this configuration, in the case where the second pivotally supporting part 25 is positioned downward the first pivotally supporting part 15, the toilet apparatus 100 can be more decreased in size compared with the case where the first pivotally supporting part 15 is positioned downward the second pivotally supporting part 25.

This point will be described specifically with reference to FIGS. 7A, 7B, 7C, and 7D.

Figure 7A:
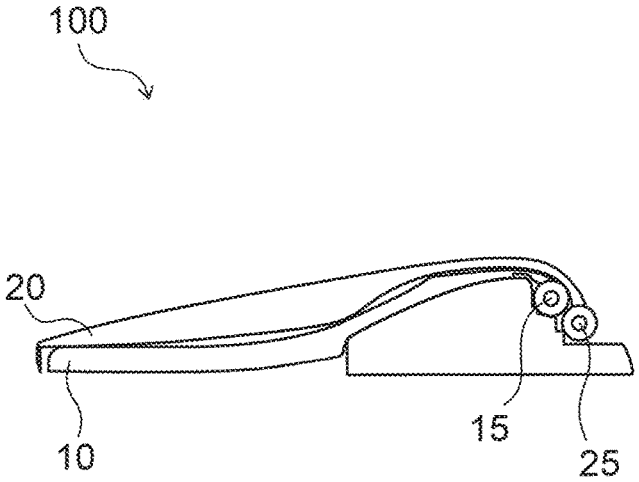
FIGS. 7A and 7B are schematic side views showing the toilet apparatus according to the embodiment.
Figure 7B:
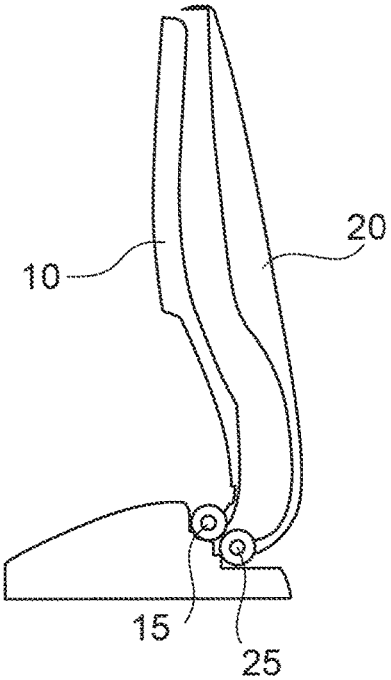
Figure 7C:
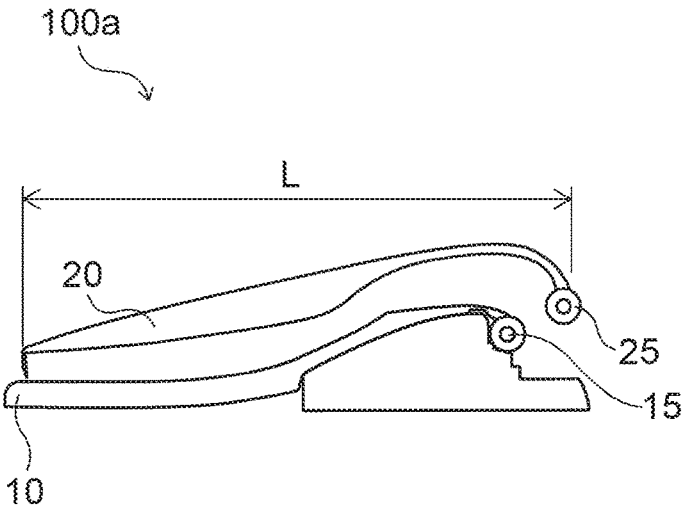
FIGS. 7C and 7D are schematic side views showing a toilet apparatus according to a comparative example.
Figure 7D:
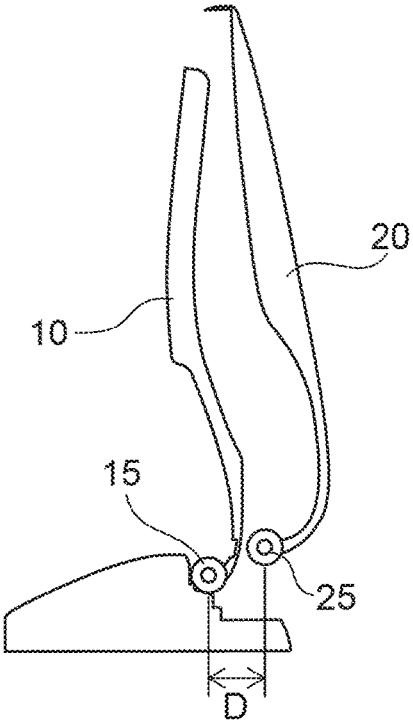

FIG. 7A and FIG. 7B are schematic side views showing the toilet apparatus 100 according to the embodiment. FIG. 7C and FIG. 7D are schematic side views showing a toilet apparatus 100*a* according to a comparative example.

In the toilet apparatus 100*a* shown in FIG. 7C and FIG. 7D, the second pivotally supporting part 25 is provided upward the first pivotally supporting part 15.

In the case of the toilet apparatus according to the comparative example, shown in FIG. 7C and FIG. 7D, when the toilet seat 10 is raised, in order to avoid the contact of the toilet seat 10 and the toilet lid 20, the toilet lid 20 and the second pivotally supporting part 25 must be moved more backward. For this reason, a distance D1 in the front-back direction between the first pivotally supporting part 15 and the second pivotally supporting part 25 becomes long. As a result, the pivotally supporting unit 35 is increased in size.

In the case where the toilet lid 20 and the second pivotally supporting part 25 are moved backward, as shown in FIG. 7C, the position of the front end when closing the toilet lid 20 goes backward by the amount of movement. Therefore, in the case where the toilet lid 20 covers the front end of the toilet seat 10, it is necessary to elongate a length L in the front-back direction in the state where the toilet lid 20 is closed, and the toilet lid 20 is increased in size.

On the other hand, as shown in FIG. 7A and FIG. 7B, in the case where the second pivotally supporting part 25 is provided under the first pivotally supporting part 15, even when the toilet seat 10 is raised and the toilet lid 20 is opened, the bent portion of rear end of the toilet seat 10 is positioned along the bent portion of the rear end of the toilet lid 20. For this reason, it is unnecessary to move the toilet lid 20 and the second pivotally supporting part 25 backward in order to avoid the contact of the toilet seat 20 and the toilet lid 20.

Therefore, according to the embodiment, the toile lid 20 and the pivotally supporting unit 35 can be decreased in size. As a result, the toilet apparatus 100 can be decreased in size.

The invention has been described with reference to the embodiments. However, the invention is not limited to these embodiments. Any design changes in the above embodiments suitably made by those skilled in the art are also encompassed within the scope of the invention as long as they fall within the spirit of the invention. For example, the shape, the size the material, the disposition and the arrangement or the like of the components included in the toilet apparatus 100 are not limited to illustrations and can be changed appropriately.

The components included in the embodiments described above can be combined to the extent possible, and these combinations are also encompassed within the scope of the invention as long as they include the features of the invention.

What is claimed is:

1. A toilet apparatus, comprising:

a toilet bowl;

a base plate provided on a rear part of the toilet bowl, a washing function part for washing an ano-genital region of a human body being mounted on the base plate;

a cover plate provided on the base plate, the cover plate covering the washing function part from above; and a toilet seat provided on the toilet bowl, the toilet seat being rotatable to the toilet bowl, in a state where the toilet seat is lowered, an outer edge of the toilet seat being positioned at a same position as or inside of an outer edge of the toilet bowl, and the toilet seat covering an entire portion of the cover plate from above, and a rear end of the toilet seat being pivotally supported to the toilet bowl by a first pivotally supporting part, and the toilet seat having a bent portion located behind a rear end of the cover plate, the bent portion being bent backward and downward, the toilet seat connected to the first pivotally supporting part at a rear end and a lower end of the bent portion.

2. The toilet apparatus according to claim 1, wherein the toilet seat includes a seating part provided with an opening, and a covering part provided behind the seating part and covering at least a portion of the cover plate from above in the state where the toilet seat is lowered, the seating part is provided so as to be distinguishable to the covering part.

3. The toilet apparatus according to claim 2, further comprising: an input unit provided on the covering part, the input unit executing washing of the toilet bowl.

4. The toilet apparatus according to claim 3, further comprising:

a toilet lid provided on the toilet seat, the toilet lid being rotatable to the toilet bowl, a rear end of the toilet lid being pivotally supported to the toilet bowl by a second pivotally supporting part, the first pivotally supporting part being provided behind the cover plate, the second pivotally supporting part being provided behind the first pivotally supporting part, and being positioned under the first pivotally supporting part, the rear end of the toilet seat being bent downward in the state of the toilet seat lowered, and the rear end of the toilet lid is bent downward in a state where the toilet lid is closed.

5. The toilet apparatus according to claim 4, wherein peripheral portions of the toilet bowl are raised in a direction toward a rear end of the toilet bowl, and the base plate is covered laterally by the raised peripheral portions of the toilet bowl.

6. The toilet apparatus according to claim 1, wherein the toilet seat includes a seating part provided with an opening, and a covering part provided behind the seating part and covering at least a portion of the cover plate from above in the state where the toilet seat is lowered, the seating part is bent downward in a convex shape in a direction from a front end of the toilet seat to a rear end of the toilet seat, the covering part is bent upward in a convex shape in the direction.

7. The toilet apparatus according to claim 6, wherein the covering part is further bent upward in a convex shape in a direction from one side of the toilet seat to another side of the toilet seat.

8. The toilet apparatus according to claim 7, further comprising: an input unit provided on the covering part, the input unit executing washing of the toilet bowl.

9. The toilet apparatus according to claim 8, further comprising:

a toilet lid provided on the toilet seat, the toilet lid being rotatable to the toilet bowl, a rear end of the toilet lid being pivotally supported to the toilet bowl by a second pivotally supporting part, the first pivotally supporting part being provided behind the cover plate, the second pivotally supporting part being provided behind the first pivotally supporting part, and being positioned under the first pivotally supporting part, the rear end of the toilet seat being bent downward in the state of the toilet seat lowered, and the rear end of the toilet lid is bent downward in a state where the toilet lid is closed.

10. The toilet apparatus according to claim 9, wherein peripheral portions of the toilet bowl are raised in a direction toward a rear end of the toilet bowl, and the base plate is covered laterally by the raised peripheral portions of the toilet bowl.

11. The toilet apparatus according to claim 1, further comprising:

a toilet lid provided on the toilet seat, the toilet lid being rotatable to the toilet bowl, a rear end of the toilet lid being pivotally supported to the toilet bowl by a second pivotally supporting part, the first pivotally supporting part being provided behind the cover plate, the second pivotally supporting part being provided behind the first pivotally supporting part, and being positioned under the first pivotally supporting part, the rear end of the toilet seat being bent downward in the state of the toilet seat lowered, and the rear end of the toilet lid is bent downward in a state where the toilet lid is closed.

12. The toilet apparatus according to claim 11, wherein peripheral portions of the toilet bowl are raised in a direction toward a rear end of the toilet bowl, and the base plate is covered laterally by the raised peripheral portions of the toilet bowl.

13. The toilet apparatus according to claim 1, wherein peripheral portions of the toilet bowl are raised in a direction toward a rear end of the toilet bowl, and the base plate is covered laterally by the raised peripheral portions of the toilet bowl.

* * * * *